United States Patent [19]

Rupprecht, deceased

[11] Patent Number: 4,847,450

[45] Date of Patent: Jul. 11, 1989

[54] STRESS GRADED ELECTRICAL BUSHING AND METHOD OF MAKING SAME

[75] Inventor: Werner Rupprecht, deceased, late of Tuerkenfeld, Fed. Rep. of Germany, by Irmgard Rupprecht, executrix

[73] Assignee: Raychem GmbH, Ottobrunn, Fed. Rep. of Germany

[21] Appl. No.: 177,797

[22] Filed: Apr. 6, 1988

Related U.S. Application Data

[63] Continuation of Ser. No. 35,578, Apr. 7, 1987, abandoned.

[51] Int. Cl.[4] ..... H01B 17/28

[52] U.S. Cl. ..... 174/143; 29/631; 174/73.1

[58] Field of Search ..... 174/73 R, 73 SC, 143; 29/631; 310/196; 361/302, 303, 305; 156/86

[56] References Cited

U.S. PATENT DOCUMENTS

| | | | |
|---|---|---|---|
| 3,646,251 | 2/1972 | Friedrich | 174/73 R X |
| 4,338,487 | 7/1982 | Matsuo | 174/143 |
| 4,370,514 | 1/1983 | Matthaus et al. | 174/143 X |
| 4,551,915 | 11/1985 | Larsson | 174/73 R X |

FOREIGN PATENT DOCUMENTS

| | | | |
|---|---|---|---|
| 0009623 | 9/1982 | European Pat. Off. | 174/143 |
| 0075471 | 3/1983 | European Pat. Off. | 174/142 |
| 1079707 | 4/1960 | Fed. Rep. of Germany | 174/143 |

*Primary Examiner*—Laramie E. Askin

*Attorney, Agent, or Firm*—Edith A. Rice; Herbert B. Burkard

[57] ABSTRACT

A high voltage bushing is formed from a plurality of insulating layers. Conductive layers are interleaved with the insulating layers, and are electrically insulated from each other. The ends of the conductive layers are overlapped by stress grading layers, to minimize the electrical stress on the bushing.

17 Claims, 3 Drawing Sheets

STRESS GRADED ELECTRICAL BUSHING AND METHOD OF MAKING SAME

Figure 1:
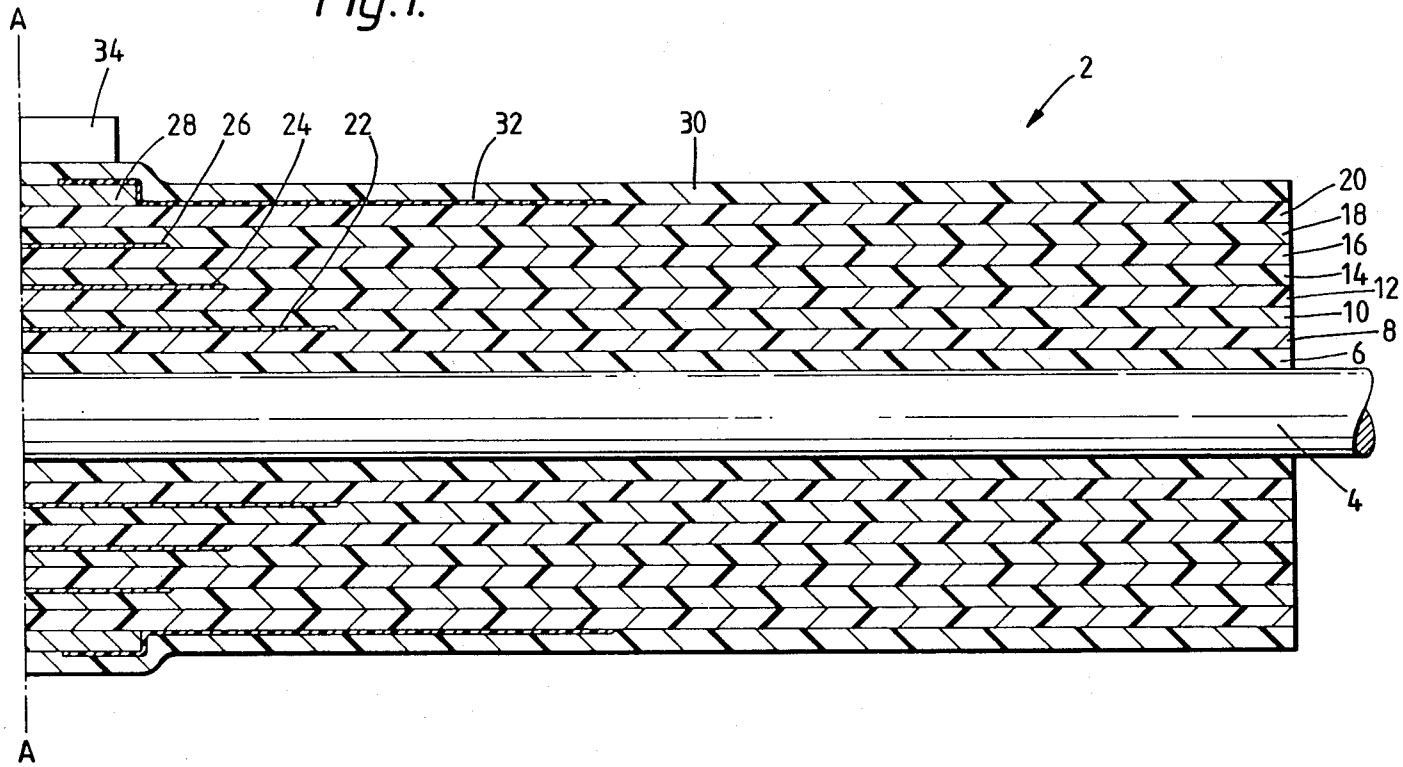

This application is a continuation of application Ser. No. 035,578, filed Apr. 7, 1987, now abandoned.

DESCRIPTION

This invention relates to an arrangement for and method of controlling the electrical stress between an elongate electrical conductor at high electric potential and a component laterally spaced therefrom at earth potential. The invention is particularly applicable to a bushing for a high voltage conductor, but is also applicable to the termination or splicing of a high voltage cable. By high voltage is meant a voltage in excess of about 1kV, and the present invention finds particular application to voltages above 24kV, for example at 36kV, 72kV and 14kV ratings.

Insulator bushing for use at potentials above about 20 kV are usually provided with stress control, which may be in the form of conductive layers, for example of metal foil, referred to as capacitor layers, so as to minimise the risk or occurrence of arcing or flashover between the enclosed high voltage conductor and the surrounding flange or other structure, which will be at earth potential. U.S. Pats. Nos. 4,362,897 and 4,387,266 disclose examples of such configuration, in which a 100 kV bushing is constructed from insulating foil, and capacitor inserts, or layers, are disposed in the insulation adjacent each tapering end face of the bushing so as to achieve a linear potential gradient along the ends of the tapered surfaces. U.S. Pat. No. 2,945,913 shows a further configuration in which a stress relief cone is prefabricated from cast resin with a conductive layer moulded into the insulating material. In each of these examples, the stress relieving structure is of generally conical configuration so as to guide equipotential surfaces gradually away from the conductor. European Patent Application Publication No. 0009623 discloses a high voltage bushing in which insulation layers are wound around a conductor to give a conical configuration, and metal foils are interleaved at the ends of the insulating layers. The metal foils are secured in place by recovering short shinkable sleeves therearound. U.S. Pat. No. 3,816,640 relates to a cable splice assembly, in which a number of elastomeric, prestretched tubes are mounted around a splice region. Longitudinally, each tube has contiguous insulating and semi-conducting portions. In one embodiment, semi-conducting portions of successive tubes are provided in tapered configuration so as to continue the shielding layer of the cables across the splice region.

GB-B-2110479 discloses an electrical bushing in which an elongate conductor is enclosed within insulating material that has an earthed flange connected to the outer surface thereof. An electrical lead from the flange extends through an outer layer of insulation to earth a conductive layer on the outer surface of a stress grading layer that is disposed on an inner layer of insulation. Each end of the earthed conductive layer is overlapped by a stress grading layer. A gap exists between the outer insulating layer and the earthed conducting layer so as to decouple the mechanical connection of the flange from its electrical connection.

U.S. Pat. No. 4,338,487 discloses a condenser bushing that is formed by winding insulating paper around a centre electrode. A conductive or semi-conductive linear electrode is provided at the side edge portions of the insulating paper, and a plurality of intermediate electrodes extend across the width of the insulating paper so as to be spaced apart from each other and so as to contact the edge electrodes. Thus, the conductive or semi-conductive edge electrodes extend continuously from the centre electrode helically out through the insulating paper with the intermediate electrodes extending physically and electrically therebetween at radially spaced apart locations. Should a continuous electrical path exist along the edge electrodes, then current will flow through the bushing, whose amount will depend on the conductivity of the path and the operating voltage.

It has been found, however, that the stress control arrangements referred to above may not control the stress sufficiently under certain operating conditions, and accordingly it is an object of the present invention to provide an arrangement for and method of providing enhanced stress control, particularly at voltages in excess of about 20 kV.

In accordance with one aspect of the present invention, there is provided an arrangement for controlling the electrical stress between an elongate electrical conductor that in use is at high potential and a component laterally spaced therefrom that in use is at a significantly lower potential and for example is substantially at earth potential, the arrangement comprising an electrically insulating body that comprises a plurality of tubular layers that are arranged to enclose the conductor along at least part of its length, a plurality of electrically conductive layers disposed within the insulating body and laterally spaced apart such that the conductive layers are electrically insulated from each other, and a stress grading layer extending longitudinally beyond each end of respective ones of the conductive layers and electrically connected thereto.

Typically, the arrangement will have a generally cylindrical configuration, with the conductive layers extending substantially concentrically around the elongate, centrally located, conductor.

In order to minimise the thickness of the stress graded capacitor layers thus formed within the insulating body, the stress grading layers preferably will be applied only at the ends of each conductive layer. However, it is envisaged that a single stress grading layer may be associated with each conductive layer so as to lie along the entire length of the conductive layer and to extend beyond each end thereof. This latter configuration may, for example, be applied only to the one, or only to the outermost, conductive layer of an arrangement.

The conductor may be a bare metal conductor, for example of copper or aluminium, or it may be a conductor that is already insulated for example an insulated bus bar, or, in the case of the arrangement comprising a termination or splice, the conductor may form part of an insulated and screened high voltage cable.

The provision of stresss grading layers at the ends of the conducting layers, that is to say at the location of maximum electrical stress, reduces the risk of electrical discharge between the high voltage conductor and the earthed component, which may be, for example, the earthed wall of a housing through which the conductor passes. Additionally, the enhanced stress control thus provided allows fewer capacitor layers and less insulation material to be employed than would otherwise be the case for a given voltage rating of the conductor. Accordingly, installation is simplified.

Preferably, the insulating body comprises polymeric material, and the arrangement, in having a plurality of electrically discrete conductive (or capacitor) layers disposed therein, avoids the occurrence of a conductive path through a bushing (for example) from the conductor to an outer, earthed flange. Such a current path could lead to undesirable heating, and possibly thermal runaway, of a polymeric bushing, which could lead to premature deterioration of the insulating material precisely at the location, at the ends of the conductive layers, where the electrical stress in the bushing is at its maximum.

The insulating body is provided as a plurality of overlapping layers, which may be generally tubular articles, and which may be recoverable, for example heat recoverable. The layers can advantageously be provided as tubes of substantially the same length such that, with the conductive and stress grading layers longitudinally contained within the insulation material, the end faces of the insulating body extend substantially perpendicularly to the axis of the conductor. With the insulating body being provided as a plurality of discrete layers, such as tubes, the conductive layers and/or the stress grading layers may be conveniently provided as inner or outer coatings, as appropriate, thereon. Alternatively, the conductive and/or stress grading layers may be provided themselves as discrete layers, such as tubes.

It will be appreciated that forming the insulating body from a plurality of tubular layers not only facilitates assembly of the arrangement, but also reduces the likelihood of voids being formed in the body. Assembly by wrapping layers of paper, such as in U.S. Pat. No. 4,338,487, on the other hand, is time consuming, and requires a high skill if trapping of air is to be avoided. Any voids formed in the insulating body are liable to give rise to electrical discharges with resulting damage to, and in extreme cases or over a long period of time destruction of, the high voltage stress grading arrangement.

Advantageously, and particularly where the arrangement is for use in adverse environment conditions, such as an atmosphere of dampness and salts, the arrangement is provided with an outermost layer that is not only insulating, but also weather resistant and substantially electrically non-tracking.

It will be appreciated that two, or more, layers of the stress control arrangement may be co-extruded, and that such a co-extrusion may be recoverable.

Polymeric, and recoverable, materials suitable for use in the arrangement of the present invention, are described in GB-B-2110479, the disclosure of which is incorporated herein by this reference.

When the insulating body is formed from layers, which may be discrete or of taped configuration, a conductive layer may be interposed between alternate ones thereof, or between every two or more of the insulating layers. It will be appreciated that such choice will be made in dependence on factors such as the thickness of the insulating layers, their dielectric strength, and the voltage rating of the arrangement. The conductive layers and stress grading layer(s) are preferably longitudinally contained within the insulation material, alternatively at least the stress grading layer(s) may be coterminous therewith or may extend longitudinally therefrom.

In configurations in which the stress control arrangement is to be mounted directly onto an uninsulated conductor, it may be desirable to dispose, for example by printing or spraying, a conductive layer on the inner surface of the insulating body, or onto the outer surface of the conductor, so that voids, for example due to surface imperfections of the conductor, are not trapped therebetween which could, in operation, give rise to electrical breakdown.

The conductive (or capacitor) layers may comprise metal foil, hot print foil, graphite or silver, which may be in spray form, for example.

The stress grading material is preferably a soft material such as a mastic so that a smooth transition may be obtained over the end of the conductive layers. In the latter context, it will be noted that since the electrical stress is greatest at the ends of the conducting layers, it is particularly important not to introduce or trap any voids at such locations.

The stress grading layers preferably comprise a high permittivity material. The high permittivity material preferably has a relative permittivity greater than 10, and most preferably greater than 15. A relative permittivity of about 20 to 25 is particularly suitable. The semiconductive material preferably has a resistivity greater than about $10^6$ ohm-cm, and advantageously is greater than about $10^9$ ohm-cm. Suitable semi-conductive materials and articles formed therefrom are disclosed in UK Patent Numbers 1433129, 1470501, 1470502, 1470503 and 1470504, the entire contents of which are incorporated herein by this reference.

Alternatively, the stress grading layers may comprise a semi-conducting material, which may have a linear or a non-linear a.c. electrical impedance. Such semi-conducting material may comprise an insulating polymeric or elastomeric material, such as polyethylene, filled with iron oxide, silicon carbide or other suitable materials.

The a.c. electrical impedance characteristic of a material is the relationship between the a.c. voltage applied to the material and the current consequently flowing therethrough. This can be expressed by the following equation:

$$I=KV\gamma p<$$

where

I is the current

V is the applied a.c. voltage

K is a constant $\gamma$ is a constant $>1$.

For a material that obeys Ohm's law, $\gamma=1$ and the impedance characteristic is a straight line, and thus the material is said to be "linear". For other materials, $\gamma>1$ and the material is said to be "non-linear". It is known that a given material may exhibit linear behaviour over a low field strength range, and non-linear behaviour over a higher field strength range, and thus may require two $\gamma$ values, different from each other but each of which is constant over a given field strength range, fully to define its characteristic.

A linear material is considered herein to be semiconductive if its specific impedance lies within the range from about $10^6$ ohm-cm to about $10^{10}$ ohm-cm, preferably from about $5\times10^7$ ohm-cm to about $5\times10^9$ ohm-cm, and most preferably from about $10^8$ ohm-cm to $10^9$ ohm-cm. A non-linear material is considered herein to be semi-conductive if its impedance at 1 kV (a.c.)/cm is between about $1\times10^7$ ohm-cm and about $1\times10^9$ ohm-cm, and preferably is about $1\times10^8$ ohm-cm, and at 10 kV (a.c.)/cm is between about $10^4$ ohmcm and about $10^8$ ohm-cm, and preferably is about $5\times10^6$ ohm-cm.

In a preferred embodiment, the arrangement of the invention is provided as a generally cylindrical high voltage bushing. The insulating body of the bushing is formed from a plurality of concentric heat recoverable tubes. The outermost insulating tube is arranged to be weather resistant and substantially non-tracking and has an earthing flange connected thereto. Conductive layers are disposed between some of the insulating tubes, and stress grading layers are disposed over the respective ends of the conductive layers. Some of the tubes and layers of the bushing may be coextruded. The components of the bushing may be mounted, for example recovered, sequentially onto a high voltage conductor, or they may be positioned around the conductor and recovered, preferably in an oven, in a single heating operation. The radial distribution of the conductive layers within the insulation and their longitudinal extent will be chosen in dependence on the relative importance of the radial and the axial distribution of the electrical stress.

In accordance with another aspect of the present invention, there is provided a method of stress grading a high voltage elongate electrical conductor, wherein a plurality of heat-shrinkable electrically insulating tubular articles are shrunk down around the conductor, a plurality of conducting layers are disposed between respective ones of the insulating articles, and a stress grading layer is disposed over each end of respective ones of the conducting layers.

In accordance with yet another aspect of the present invention, there is provided a method of forming a high voltage bushing, wherein a plurality of electrically conductive layers is disposed within a generally tubular insulating body that has an aperture extending axially therethrough for receiving a high voltage conductor, wherein the conductive layers are arranged to extend concentrically around the aperture and to be electrically insulated from each other and from the conductor, and wherein a stress grading layer is arranged to extend longitudinally beyond each end of respective ones of the conductive layers in electrical connection therewith.

The methods advantageously employ the arrangement of said first aspect of the invention.

Although it is envisaged that the insulating body may comprise discrete layers of heat recoverable tubing, which may thus be recovered sequentially, for example by a gas torch, around the conductor, it is also envisaged that all the layers of the arrangement could be assembled together and recovered around, for example onto, the conductor in a single heating operation. Such a heating operation would advantageously be effected in an oven, due to the thickness of material involved.

The innermost insulating layer of the arrangement may be extruded directly onto an elongate conductor, and other insulating layers and the conductive and stress grading layers may also be extruded into postion.

It will be appreciated that the voltage rating of the stress control arrangement, for example bushing, will determine the thickness of insulation required, and the number of conductive, capacitor layers required. However, typically, for a 72 kV bushing for example, between ten and twenty capacitor layers would be required in the absence of the stress grading layers provided in the present invention, whereas in an arrangement in accordance with the present invention, four capacitor layers in a total insulation thickness of about 20 mm would be sufficient for at least some applications.

Preferably, each of the insulating layers (when a layered construction is employed for the insulating body) and each of the conductive and stress grading layers has a substantially uniform thickness along its entire length, and preferably each layer is at a substantially uniform diameter about the conductor along its entire length.

The overlap between the stress grading layer and its associated conductive layer will be chosen so as to ensure that no undesirable electrical discharge takes place at the end of the conductive layer. Typically, such overlap would be between about 25 mm and 75 mm, and preferably between about 35 mm and 50 mm.

When, advantageously, the insulating body is provided by layers of tubing, these may be of different lengths such that a tapered end face is obtained, but it is envisaged that all the tubings will be of substantially the same length so that the end face of the insulating material will extend generally perpendicularly to the axis of the conductor.

When the arrangement of the invention provides an insulator bushing, the bushing will typically be earthed at its outermost surface halfway or otherwise part way along the length of the insulating body. Preferably then, each conducting layer extends continuously for some distance, and, for example, symmetrically on each side of the earthing point, which may be the wall of an earthed housing through which the conductor passes.

The lateral disposition and the length and relative lengths of the conductive layers may in general be arranged to provide different kinds of stress control, depending on whether it is the radial electrical stress, the axial electrical stress, or a compromise combination of radial and axial stress that is to be primarily controlled.

Figure 2:
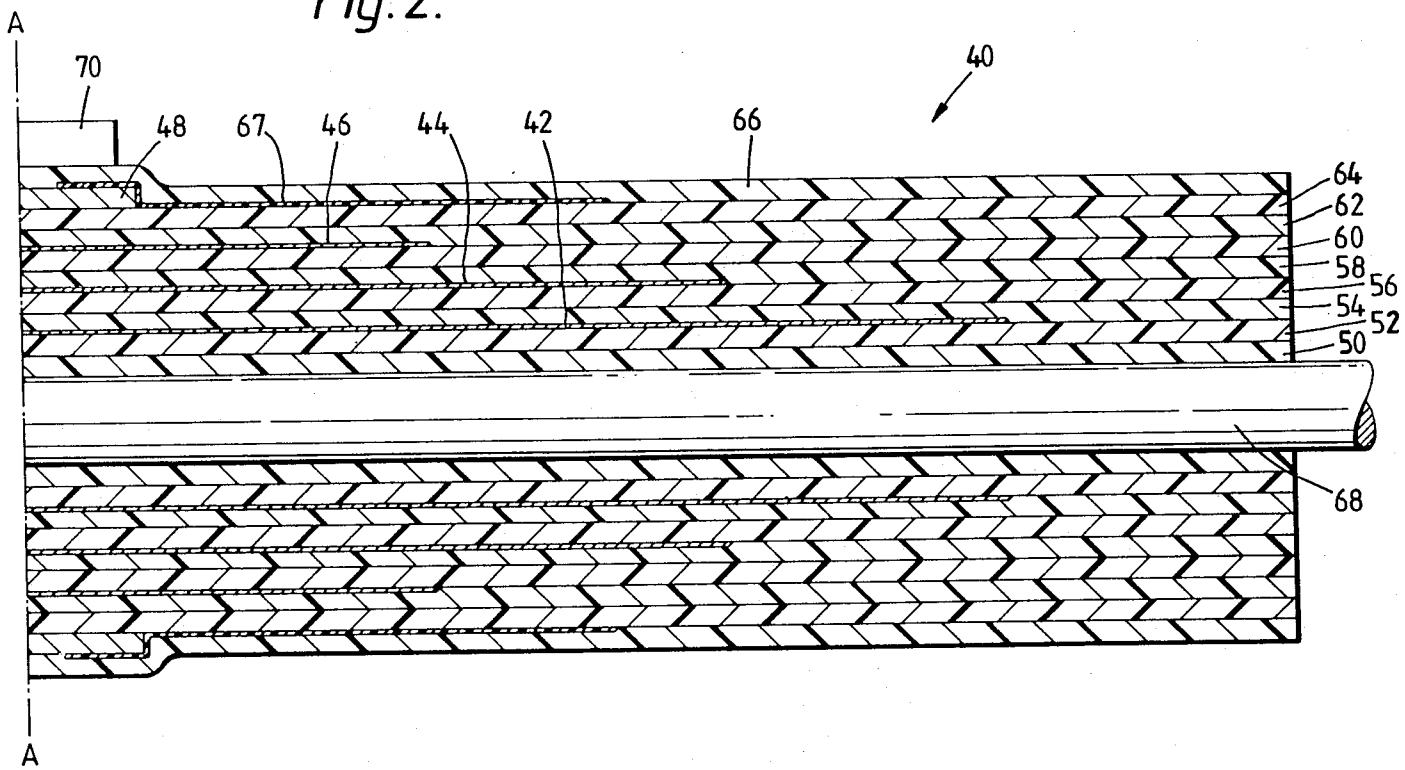
Figure 3:
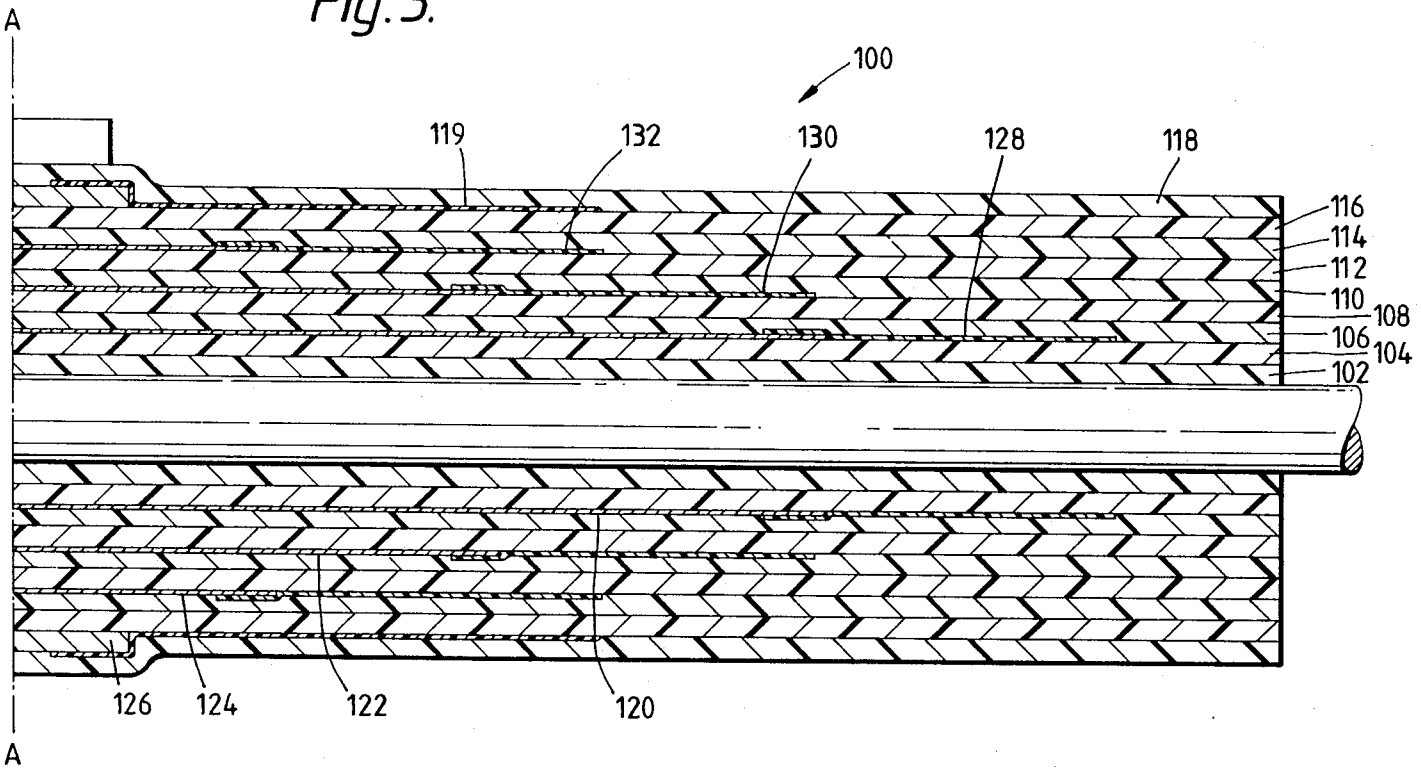

High voltage bushings in accordance with the present invention, will now be described, by way of example, in which:

FIGS. 1 to 3 show sectional elevations of half the lengths of three embodiments of the bushings.

FIG. 1 shows a 72 kV bushing 2 having a solid insulated metal conductor 4 of circular cross-section extending therethrough. Layers 6, 8, 10, 12, 14, 16, 18 and 20 are provided by Raychem heat-shrinkable insulated BBIT tubings, which are recovered in an oven onto the conductor 4 to form the insulating body of the bushing. The tubing has an electric strength of 180 kV/cm (based on a 2mm wall thickness), a dielectric constant of 3, and a volume resistivity of $2\times10^{14}$ ohm-cm. The bushing 2 is provided with four capacitor layers 22, 24, 26 and 28 formed from metal foil that are interposed between pairs of the insulating layers 6 to 20, with the conducting layer 28 being disposed on top of the outer BBIT insulation layer 20. The capacitor layers, and the other bushing components, extend symmetrically to each side of the centre line A—A of the bushing 2 and progressively decrease in length in radial progression outwards from the central conductor 4.

An outermost insulation layer 30 is provided from Raychem heat-shrinkable HVTM tubing that in addition to having electrical properties similar to the abovementioned BBIT tubing is also substantially weather resistant and nontracking (in accordance with the ASTM D 2303 Inclined Plane test). The HVTM tubing 30 has two spaced apart portions of an internal coating 32 of a semi-conductive stress grading mastic having a non-linear a.c. electrical impedance characteristic. The coating 32 extends longitudinally symmetrically over each end of the outer conductive foil 28 and along the surface of the outer BBIT insulating layer 20 a distance beyond the end of the innermost conductive foil 22. The eight BBIT insulating layers 6 to 20 and the HVTM insulating layer 30 are coterminous. The mastic quality of the stress-grading coating 32 will ensure that any voids at the ends of the outer conductive foil 28, which is thicker than the inner foils 22, 24 and 26, and between the foil 28 and the outermost insulating layer 30, will be filled on recovery of the bushing and flow of the mastic during the heating process of the mounting of the bushing 2 on the conductor 4.

The bushing 2 is completed by the attachment of a conducting radial flange 34 centrally to the HVTM insulating layer 30 in the region of the thickened outermost conducting foil 28. The flange 34 acts as an earthing mounting for the bushing 2, for example onto the earthed wall of a housing through which the conductor 4 passes in use.

The conducting capacitor layers 22, 24, 26 and 28 extend respectively for about 26%, 16%, 12%, and 10% of the total length of the cylindrical bushing. Such comparatively short conductive layers leave a comparatively long length of the insulation of the bushing not stress-controlled. Consequently, the configuration of FIG. 1, whilst giving a substantially constant radial electric stress (of about 2.2 kV/m), since the capacitance between successive layers is substantially equal, does not have a particularly good axial stress distribution. Bushing 2, under high voltage and certain adverse conditions, could consequently be subject to flashover from the high voltage conductor 4 to the earthed flange 34. It is to be understood, however, that the stress control provided as shown in FIG. 1, could provide a quite suitable bushing under less demanding conditions of use. Furthermore, the stress controlling of the bushing 2 maybe enhanced by applying stress-grading material, for example the mastic 32 at the ends of some or each of the conductive layers 22, 24 and 26.

Although as shown in FIG. 1, the bushing 2 has a stress grading layer associated with only one of the conductive layers, it is to be understood that stress grading would be applied to the ends of one, and preferably each, of the conductive layers.

The bushing 40 of FIG. 2 is a modification of the bushing 2 of FIG. 1, in that the lengths of the inner three conductive layers 42, 44 and 46 are increased with respect to the corresponding layers 22, 24 and 26 respectively of the bushing 2. In all other respects, the bushing 40 is similar to the bushing 2. The lengths of the capacitor layers 42, 44, and 46 are chosen so that the axial distance from the end of the bushing to the end of the longest (innermost) layer, 42, is equal to the axial separation of the ends of successive ones of each of the conductive layers 42, 44, 46 and 48.

The configuration of bushing 40 produces different capacitances between the insulating layers 50, 52, 54, 56, 58, 60, 62 and 64, and internally coated insulation layer 66, and a constant axial electric stress in these layers. This does, however, give rise to a comparatively high electrical stress in the outer layer of insulation, which can have as much as half the total potential difference between the conductor 68 and the earthed flange 70 applied across it. The stress grading of the bushing 40 may be enhanced by providing stress grading not only of the outer foil layer 48, by the stress grading layer 67 coated inside the outermost insulating layer 66, but also at the ends of the inner layers 42, 44 and 46.

Although as shown in FIG. 2, the bushing 40 has a stress grading layer associated with only one of the conductive layers, it is to be understood that stress grading would be applied to the ends of one, and preferably each, of the conductive layers.

The 72 kV bushing 100 of FIG. 3 is built up from eight BBIT insulation tubes 102, 104, 106, 108, 110, 112, 114 and 116 and an outer HVTM insulation tube 118. As before, four conductive layers, 120, 122, 124 and 126, are disposed between successive pairs of BBIT tubings, with metal foil layer 126 being mounted on the outer surface of the outermost BBIT tube 116. The foils 120, 122, 124 and 126 are each mounted symmetrically about the centre-line A—A of the bushing 100, and extend therefrom for lengths intermediate the length for which the corresponding layers of the bushings 2 and 40 extend. Also as before, the outermost, HVTM, insulation tubing 118 is internally coated over two portions of its length with a non-linear stress grading mastic 119. Additionally, however, a coating 128, 130 and 132 of the mastic material is applied at two longitudinally spaced apart locations symmetically disposed about the bushing centre line A—A to the inside of each of the insulation tubings 106, 110 and 114 such that when these tubings are recovered onto their respective inner layers, that consist of insulation partially covered by conductive foil, the stress grading material overlaps each end of the respective inner conductive layer for a short distance and extends axially away therefrom along the respective inner insulating layer, filling any voids at the conductive/insulating interfaces. Thus, stress grading material is applied to each end of each of the conductive layers, and in a particularly convenient manner.

Although the configuration of capacitor and stress grading layers of the bushing 100 does not provide either a constant radial or a constant axial stress distribution, the stress control thus provided is enhanced overall with respect to that of the bushings 2 and 40.

The bushing 40 has an overall length of about 1650 mm, and an overall diameter of about 80 mm, with a wall thickness of the insulation material of about 22 mm.

The bushing 40 was subjected to testing of its electrical properties, and was found to have a discharge extinction voltage of 60 KV, and to pass the 1 minute AC-withstand test at 140 kV, and to pass the ± 325 kV withstand test.

Although as described above, the stress grading material can be applied to the conductive layers as a mastic, it may alternatively be applied as a tape, or as a tubing, for example a recoverable and especially a heat recoverable tubing. In the latter respect, Raychem SCTM stress control tubing may be used. SCTM tubing has a dielectric constant of 22, and a volume resistivity of $1\times10^{12}$ ohm-cm, with a linear a.c. electrical impedance characteristic. However, it is preferred that the thickness of the stress grading layer, and advantageously also of the conductive layer, does not exceed about 0.1 mm, so as to minimise the occurrence and size of voids at the interfaces between these layers and the insulating material. It will be appreciated that any steps at such interfaces should be filled so as to prevent, or at least minimise electrical breakdown in these regions.

The mastic material advantageously is a stretchable tape having a relative permittivity of at least 10, of epichlorohydrin—based rubber containing an anti-tracking filler such as alumina trihydrate.

Although the stress grading material is required to control the electrical stress at the ends of the conductive layers, it is envisaged that it may be convenient for such material also to extend over the entire length of the conductive layers. This may be particularly appropriate when the stress control material is provided by a relatively none conformable, for example thick, layer, that would otherwise give rise to voids at the ends of the conductive layers.

Furthermore, since in operation the stress control arrangement will be subject to thermal cycling, it is important that elastic materials be selected, preferably having comparable thermal coefficients of expansion, so that no voids are created during operation.

Typically, the thickness of each insulation layer is between about 2.0 mm and 4.0 mm, these being the values after recovery where recoverable material is involved, and the bushing length is in the range of about 1000 mm to about 1800 mm. These values are given for a 72 kV bushing, and would be correspondingly different for other voltage ratings. It is also to be understood that the total thickness of insulation, the number and lengths of conductive layers, and the number and lengths and overlap lengths of the stress grading layers, will each depend on the voltage rating of the bushing and on the environment in which it has to operate.

I claim:

1. An arrangement for controlling the electrical stress between an elongate electrical conductor that in use is at high potential and a component laterally spaced therefrom that in use is at earth potential, the arrangement comprising an electrically insulating body that comprises a plurality of tubular layers that are arranged to enclose the conductor along at least part of its length, a plurality of electrically conductive layers disposed within the insulating body and laterally spaced apart such that the conductive layers are electrically insulated from each other, and a plurality of stress grading layers that overlap the ends of respective ones of the conductive layers so as to be electrically connected thereto and that extend longitudinally beyond the ends of the conductive layers towards but not beyond the ends of the insulating layers.

2. An arrangement according to claim 1, wherein each stress grading layer is formed from material having a relative permittivity greater than 10.

3. An arrangement according to claim 1, wherein the insulating body comprises polymeric material.

4. An arrangement according to claim 1, having a generally cylindrical configuration with the conductive layers in use extending substantially concentrically around the elongate conductor.

5. An arrangement according to claim 1, wherein the insulating body is provided as a plurality of overlapping layers, and wherein the conductive layers are disposed between the insulating layers.

6. An arrangement according to claim 5, wherein each conductive layer is provided as a coating on a relatively outer layer of the insulating body.

7. An arrangement according to claim 5, wherein each stress grading layer is provided as a coating on a relatively outer layer of the insulating body.

8. An arrangement according to claim 1, wherein at least one of the conductive layers and the stress grading layers is provided as a tubular article.

9. An arrangement according to claim 1, wherein at least one of the conductive layers and the stress grading layers is provided as a recoverable article.

10. An arrangement according to claim 9, wherein the article is recoverable by the application of heat thereto.

11. An arrangement according to claim 1, comprising an electrically conductive layer on the outer surface of the insulating body that in use is electrically connected to earth potential.

12. An arrangement according to claim 1 formed as a high voltage insulating bushing.

13. A high voltage stress graded bushing of generally cylindrical configuration, comprising:

a plurality of substantially concentrically disposed electrically insulating tubular layers;

a plurality of electrically conductive tubular layers disposed between said insulating layers; and a plurality of stress grading tubular layers overlapping and electrically connected to the ends of said plurality of conductive layers and extending therefrom towards but not beyond the ends of the insulating layers.

14. A bushing according to claim 13, wherein at least one of said insulating, conductive and stress grading layers comprises a recoverable tubular article.

15. A method of stress grading a high voltage elongate electrical conductor, comprising shrinking a plurality of heat-shrinkable electrically insulating tubular articles around the conductor, disposing a plurality of conductive layers between respective ones of the insulating articles, and disposing a stress grading layer over each end of respective ones of the conductive layers extending therefrom towards but not beyond the ends of the insulating articles.

16. A method of forming a high voltage bushing, comprising disposing a plurality of electrically conductive layers within a generally tubular insulating body that has an aperture extending axially therethrough for receiving a high voltage conductor, the conductive layers being arranged to extend concentrically around the aperture and to be electrically insulated from each other and from the conductor, and arranging a stress grading layer to extend longitudinally beyond each end of respective ones of the conductive layers in electrical connection therewith, towards but not beyond the ends of the insulating body.

17. A method according to claim 16, wherein the insulating body is formed from a plurality of insulating tubular articles.

* * * * *